US008974275B2

(12) United States Patent
Woods et al.

(10) Patent No.: US 8,974,275 B2
(45) Date of Patent: Mar. 10, 2015

(54) PASSIVE VENTILATION STACK

(75) Inventors: Andrew W. Woods, Whittlesford (GB); Shaun D. Fitzgerald, Cambridge (GB)

(73) Assignee: Cambridge Enterprise Limited, Cambridge (GB)

( * ) Notice: Subject to any disclaimer, the term of this patent is extended or adjusted under 35 U.S.C. 154(b) by 1745 days.

(21) Appl. No.: 11/920,459

(22) PCT Filed: May 16, 2006

(86) PCT No.: PCT/GB2006/001811
§ 371 (c)(1),
(2), (4) Date: Jun. 9, 2008

(87) PCT Pub. No.: WO2006/123139
PCT Pub. Date: Nov. 23, 2006

(65) Prior Publication Data

US 2008/0254730 A1 Oct. 16, 2008

(30) Foreign Application Priority Data

May 16, 2005 (GB) ..... 0510007.8

(51) Int. Cl.

| | |
|---|---|
| ***F24F 7/02*** | (2006.01) |
| ***F24F 7/04*** | (2006.01) |
| ***F24F 11/00*** | (2006.01) |
| *F24F 7/00* | (2006.01) |

(52) U.S. Cl.
CPC ... *F24F 7/04* (2013.01); *F24F 7/02* (2013.01); *F24F 11/0001* (2013.01); *F24F 2007/001* (2013.01); *F24F 2007/004* (2013.01)
USPC ..... 454/242; 454/238; 454/250

(58) Field of Classification Search
USPC ..... 454/238, 241, 242, 243, 250, 255, 340, 454/358, 237, 363
See application file for complete search history.

(56) References Cited

U.S. PATENT DOCUMENTS

| | | | | | |
|---|---|---|---|---|---|
| 36,981 | A | * | 11/1862 | McKinnel | 454/242 |
| 44,196 | A | * | 9/1864 | Hyslop | 454/242 |
| 679,932 | A | * | 8/1901 | Abrahamson | 454/8 |
| 764,965 | A | * | 7/1904 | Tousley | 454/363 |
| 3,463,391 | A | * | 8/1969 | Haegens | 236/49.1 |

(Continued)

FOREIGN PATENT DOCUMENTS

| | | |
|---|---|---|
| DE | 202004002376 | 7/2004 |
| FR | 2420724 | 10/1979 |

(Continued)

OTHER PUBLICATIONS

International Search Report for International Application No. PCT/GB06/001811, issued by the International Searching Authority, dated Jun. 28, 2006.

(Continued)

*Primary Examiner* — Kevin Murphy
(74) *Attorney, Agent, or Firm* — Baker Hostetler LLP

(57) ABSTRACT

A passive ventilation stack for a room, building or the like comprises an interior space and first and second openings providing fluid communication between the interior space and a room to be ventilated, and the outside atmosphere. A control system is provided for varying the size of the openings, so as to cause natural heat exchange between relatively cool ventilation air entering the stack from outside and relatively warm air entering the stack from a room or building to be ventilated.

29 Claims, 5 Drawing Sheets

(56) References Cited

U.S. PATENT DOCUMENTS

| | | | | |
|---|---|---|---|---|
| 4,437,608 | A * | 3/1984 | Smith | 236/13 |
| 6,450,414 | B1 | 9/2002 | Dartnall et al. | |

FOREIGN PATENT DOCUMENTS

| | | |
|---|---|---|
| FR | 2474657 | 7/1981 |
| GB | 373078 | 12/1931 |
| JP | 58-130920 | 4/1983 |
| JP | 58130920 | 8/1983 |
| JP | 08094138 | 4/1996 |
| JP | 11310970 | 11/1999 |
| WO | WO 8607438 | 12/1986 |

OTHER PUBLICATIONS

Search Report for Application No. GB 0510007.8, issued by The Patent Office, dated Oct. 4, 2005.

Windcatcher Natural Ventilation Systems; Monodraught; Nov. 2002.

The North of Scotland College of Agriculture; A Design Guide to Mechanically Ventilated Livestock Housing; Bulletin No. 26; Oct. 1981.

* cited by examiner

PASSIVE VENTILATION STACK

CROSS-REFERENCE TO RELATED APPLICATIONS

The present application is a National Phase Application of International Application No. PCT/GB2006/001811, filed May 16, 2006, which claims priority to Great Britain Patent Application No. 0510007.8, filed May 16, 2005, which applications are incorporated herein fully by this reference.

The present invention relates to a passive ventilation stack for a room, building or the like, and to a method of ventilating a room, building or the like.

Passive stacks are well known as devices for extracting warm air from the upper regions of a room or building, with incoming air being admitted via inlets lower down in the room or building. In winter, such incoming air will need to be heated for the comfort of occupants and this is wasteful.

Other systems for ventilating rooms and the like include air conditioning devices. These however are energy intensive devices that can be expensive to operate, and do not function without electrical input.

It is therefore desirable to produce a ventilation system that is both relatively efficient and cost effective, and which need not rely on electrical input for power.

According to a first aspect of the present invention, there is provided a passive ventilation stack for a room, building or the like, the stack having an interior space, a first opening which in use provides two way fluid communication between the interior space and the room, building or the like to be ventilated, and a second opening which in use provides two way fluid communication between the interior space and ambient atmosphere, and a control device for varying the size of each of the first and second openings.

An advantage of this passive ventilation stack is that cooler ventilation air entering the stack from outside is able to mix in the interior space with warmer air from the room or building to be ventilated, such that ventilation air is provided to a room at a controlled temperature that is comfortable to the occupants of the room, without the need for electrical or other form of power to preheat the ventilation air. This in turn can make the system cheaper to operate than prior art systems.

Further aspects of the invention are as claimed in claim 3 and claim 4.

The size of the first opening and the size of the second opening may be independently variable.

The stack may provide substantially the only inlet of the ambient atmosphere into the room, building or the like to be ventilated. In this manner, the passive ventilation stack operates most efficiently.

The control device may comprise an electric stepper motor. The control device may comprise a fluid thermostat.

At least two said interior spaces may be provided in series. Preferably, a third independently variable opening is provided between the said interior spaces to provide fluid communication therebetween.

The passive stack may include at least one sensor, the output of which provides an input to the control device. The sensor may comprise a temperature sensor. At least one further sensor may be provided in the room, building or the like to be ventilated. The further sensor may comprise a temperature sensor and/or a $CO_2$ sensor.

According to a second aspect of the present invention, there is provided a method of ventilating a room, building or the like having a first variable size opening in an upper region of the said room, building or the like, said first opening providing fluid communication with an interior space substantially adjacent the room, building or the like, said interior space having a second variable size opening providing fluid communication with the atmosphere, the method comprising the steps of controlling the size of the first opening such that room air in said upper region passes via said opening into the interior space, and controlling the size of the second opening such that ventilation air from the atmosphere enters the interior space, to cause heat exchange by mixing in said interior space of relatively warm room air and relatively cool ventilation air, such that warmed ventilation air is passed into the room, building or the like, and room air from the upper region passes to the atmosphere, substantially without external power.

Still further aspects of the invention are as claimed in claims 25 and 26.

The first variable size opening and second variable size opening may be independently controllable by a control device.

The method may comprise the further step of obtaining air temperature measurements in the interior space, outside of the interior space and in the room or building to be ventilated, and controlling the size of the first opening and the second opening based upon the said air temperature measurements.

The method may comprise the further step of obtaining a $CO_2$ concentration measurement in the room or building to be ventilated, and controlling the size of the first opening and the second opening based upon the said $CO_2$ concentration measurement.

The passive ventilation stack may be installed on a room, building or the like, and the installation may include at least one sensor in the interior space, at least one said sensor in the room, building or the like, and at least one sensor located in the atmosphere external to the interior space.

The interior space may include at least two said first openings and at least two said second openings provided at spaced locations on the room, building or the like. This arrangement can be advantageous where large rooms, buildings or the like are to be ventilated.

The passive ventilation stack may be located at the top of the room, building or the like.

An additional power source may be provided to ensure mixing of air in the interior space. The additional power source may comprise a fan. At least one splitter plate may be provided within said interior space to ensure mixing of air in the interior space.

An embodiment of the invention will now be described by way of example only with reference to the accompanying drawings, in which.

Figure 1:
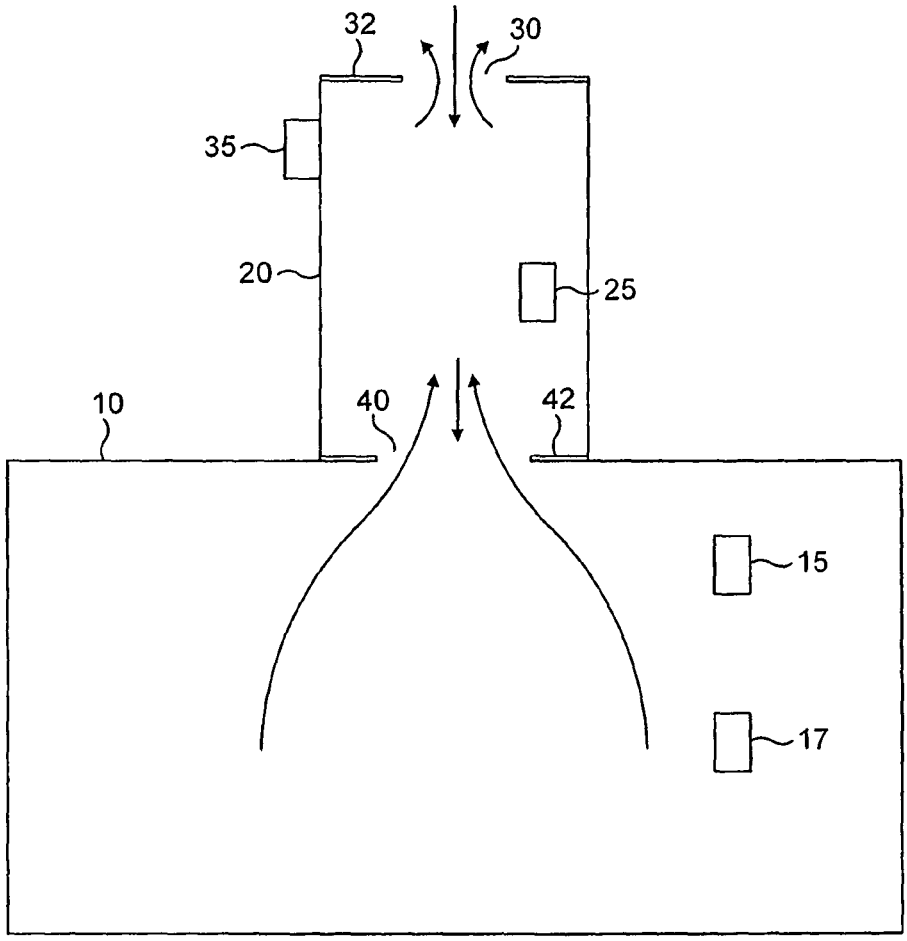
FIG. 1 shows a schematic view of a building having a ventilation stack according to the invention.

Referring to FIG. 1, a room or building 10 has a single ventilation stack 20 mounted at the top of the room or building. The stack 20 has a first lower opening 40 leading into and providing fluid communication with an interior space 41. The lower opening 40 has a valve member 42 for selectively varying the size of the first opening. The term 'size' can include single dimensional quantities such as length or width of the opening, or it could be a two-dimensional area. The valve member 42 is controlled in this embodiment by an electric stepper motor (not shown), but other devices, such as a fluid thermostat (not shown) directly controlling the member could be provided. The valve member 42 may be a slide valve or any other suitable opening-controller, including an iris-type diaphragm, or a single or multi-blade damper such as is well known in the art.

The stack has a second upper opening 30 from the interior space to the outside. The upper opening 30 has a valve member 32 for selectively varying the size of the second opening 30. The valve member 32 is controlled in this embodiment by an electric stepper motor (not shown), but other devices, such as a fluid thermostat (not shown) directly controlling the member could be provided. The valve member 32 may be a slide valve or any other suitable opening-controller, including an iris-type diaphragm.

The passive ventilation stack system operates most efficiently in a room or building in which there is substantially no other source of inlet air into the room or building 10—for example when any windows and doors are closed. In this manner, the system is not dependent upon exterior wind conditions to admit cooler ventilation air into the stack. When the room or building 10 is occupied with people or computers or other heat sources, the room air warms up and naturally rises into an upper region 50 of the room or building. The warm room air passes through opening 40 into the stack 20 at a controlled flow rate, dependent upon the size of the opening 40. The room air passes through the stack 20 and through opening 30, again at a controlled flow rate that is dependent upon the size of the opening 30. As the opening 30 is substantially the only inlet/outlet of air into and out of the room or building 10, the room air leaving the stack 20 is replaced by incoming cooler ventilation air. This ventilation air enters the stack 20 through opening 30 at a controlled flow rate dependent upon the size of the opening 30. Once inside the stack 20, the ventilation air is able to mix with the warmer room air such that a degree of natural heat exchange takes place between the two streams of air. The ventilation air becomes warmer whilst the room air becomes cooler. The warmed ventilation air then passes through the opening 40 at a controlled flow rate dependent upon the size of the opening 40, and into the room or building 10 where it falls to occupant level at a temperature that is comfortable to the occupants.

A temperature sensor 15 is located in the interior of the room or building 10 in order to measure the room temperature. A second temperature sensor 25 is located in the stack 20 for measurement of the stack temperature. A third temperature sensor 35 is located outside of the stack 20, close to the upper end thereof, for measurement of the ambient air temperature outside of the room/building. In the present embodiment, a $CO_2$ sensor 17 is also present in the room or building 10. The measurements recorded by each of the sensors 15, 25, 35 and 17 are used as input data into an algorithm for controlling the size of the openings 30 and 40. The algorithm computes the desired ratio of size of the openings 30 and 40 that will provide a desired stack temperature, measured at temperature sensor 25, where the desired stack temperature is higher than the external ambient temperature, measured at temperature sensor 35, but lower than the internal room or building temperature, measured at temperature sensor 15.

The output of the algorithm is used by the electric stepper motor or other controlling device to adjust the valve members 32 and/or 42 independently of each other to automatically produce the desired stack temperature.

In an embodiment, the desired stack temperature ($T_s$) is interpolated using the outside temperature ($T_e$), and the temperature inside the room to be ventilated ($T_i$):

$$T_s = T_e + (T_i - T_e) \times f(A_2/A_1)$$

where $A_2$ and $A_1$ are the areas of the second opening 30 and the first opening 40 respectively.

The optimum value of the function $f$ can be empirically determined by the skilled person, depending upon the stack design and the specific geometry of the openings.

In the present embodiment, the desired size of the openings 30 and 40 is also a function of the optimum $CO_2$ level inside the room, measured at sensor 17. For example, if the sensor 17 detects that there is too high a concentration of $CO_2$ in the room or building, the openings 30 and 40 can be increased in size whilst maintaining the optimum ratio of size of the two openings.

Figure 2:
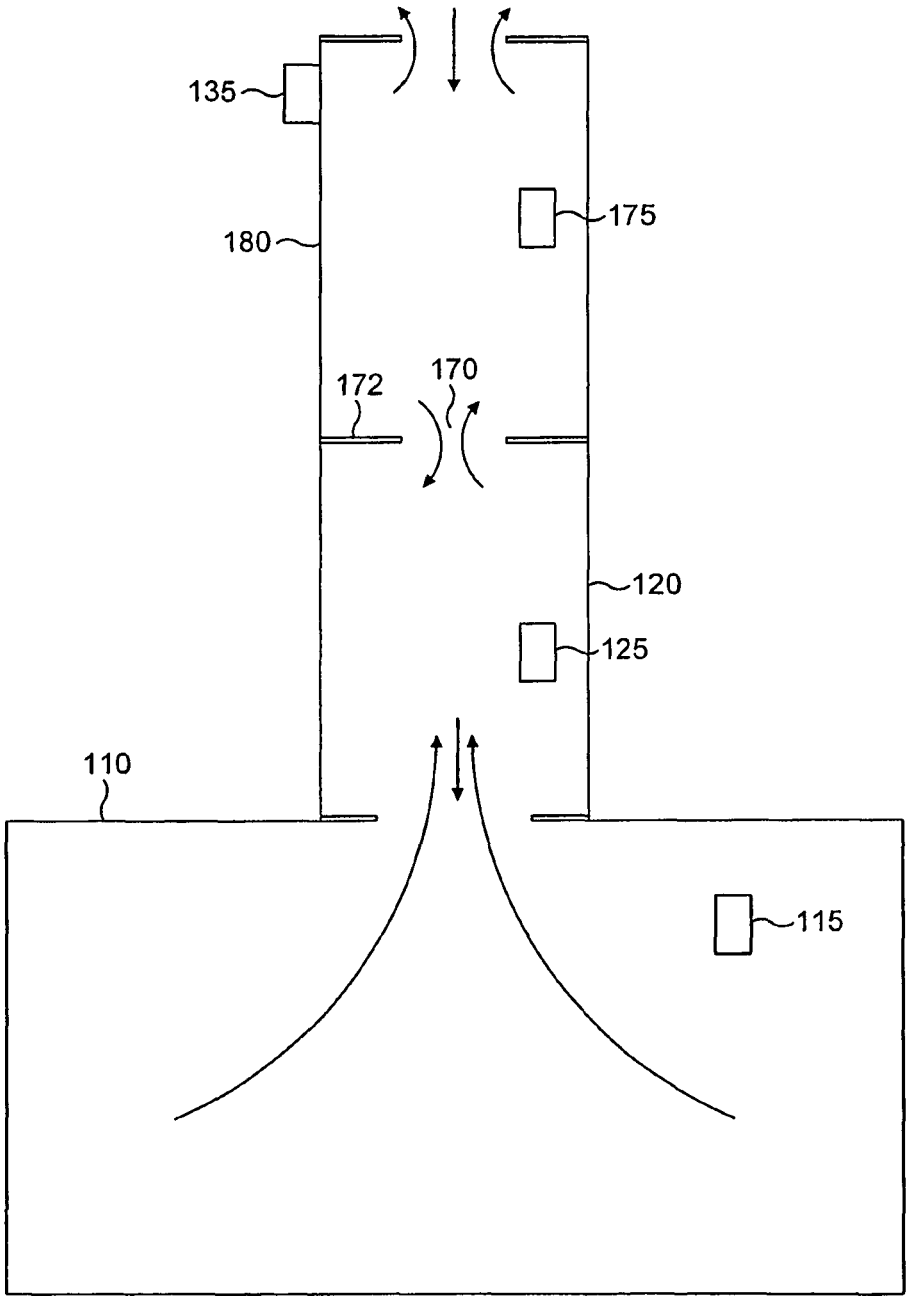
FIG. 2 shows a schematic view of a building having two ventilation stacks according to a second embodiment of the invention.

In a second embodiment of the invention, more than one stack may be appropriate as shown in FIG. 2. This arrangement can enhance the mixing of ventilation air and room air, providing further control of the temperature of air moving into the room, building or the like 110. This arrangement may be particularly appropriate where there is a relatively large temperature difference between the atmospheric air temperature and the room temperature. In this embodiment, a second stack 180 is located adjacent to and above a first stack 120, as shown in FIG. 2. However, the two stacks need not be vertically stacked and could be located side by side. A third opening 170 provides fluid communication between an interior space of the first stack 120 and an interior space of the second stack 180. A third valve member 172 is provided in the opening 170 for selectively varying the size thereof. In addition to temperature sensors 115, 125 and 135, a further temperature sensor 175 in the second interior space of second stack 180 provides an additional input into the algorithm.

Figure 3:
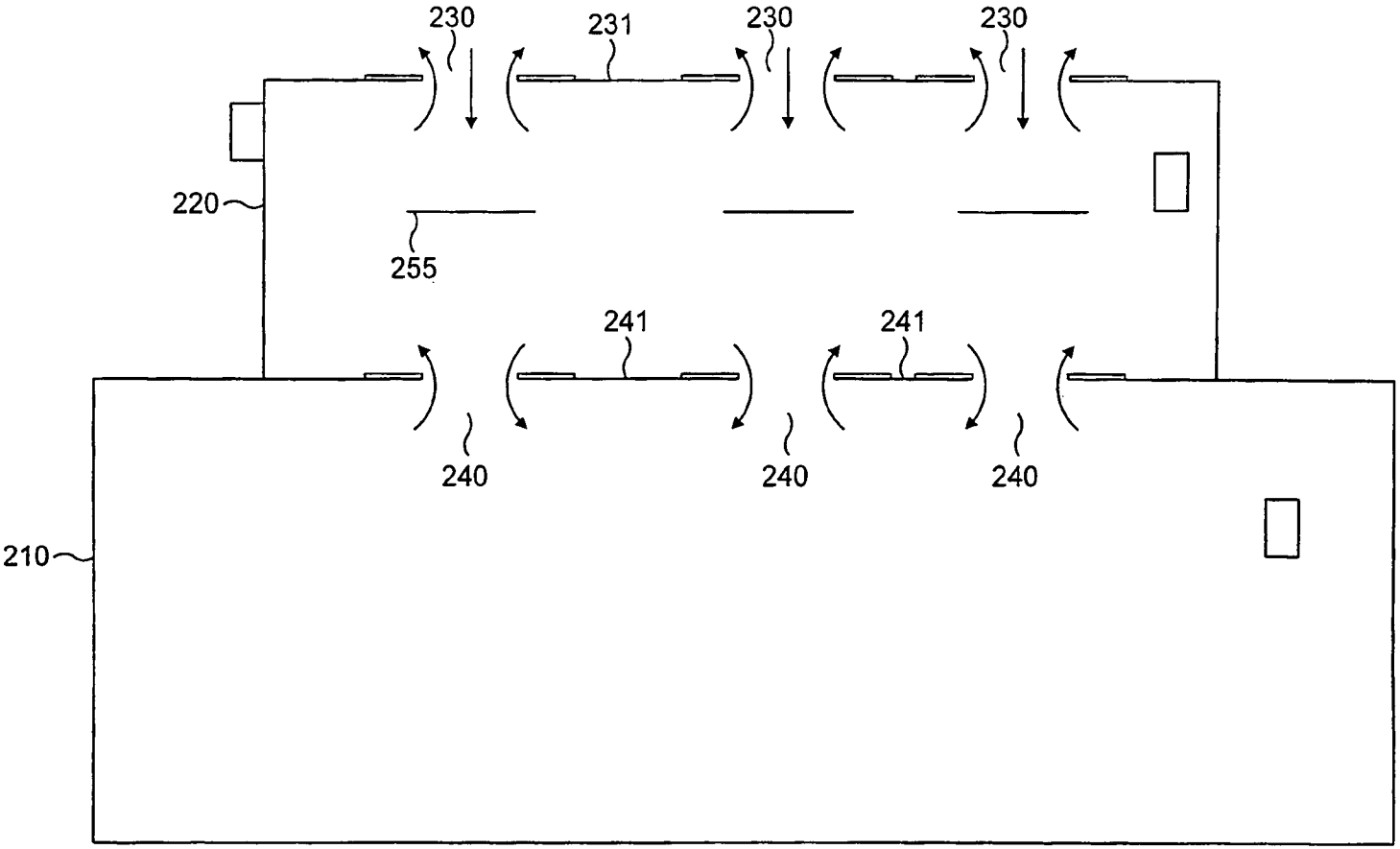
FIG. 3 shows a schematic view of a building having a ventilation stack according to a third embodiment of the invention.

In a third embodiment of the invention as shown in FIG. 3, a large room or building 210 has an elongate stack 220 mounted on top of the room or building, the stack 220 having multiple lower openings 240 in a lower wall 241 of the stack and multiple upper openings 230 in an upper wall 231 of the stack, at spaced locations thereon. A fan (not shown) is optionally employed to assist mixing of the ventilation air with the room air in the stack 220. Alternatively, one or more splitter plates 255 are optionally employed to assist mixing of the ventilation air and the room air.

Figure 4:
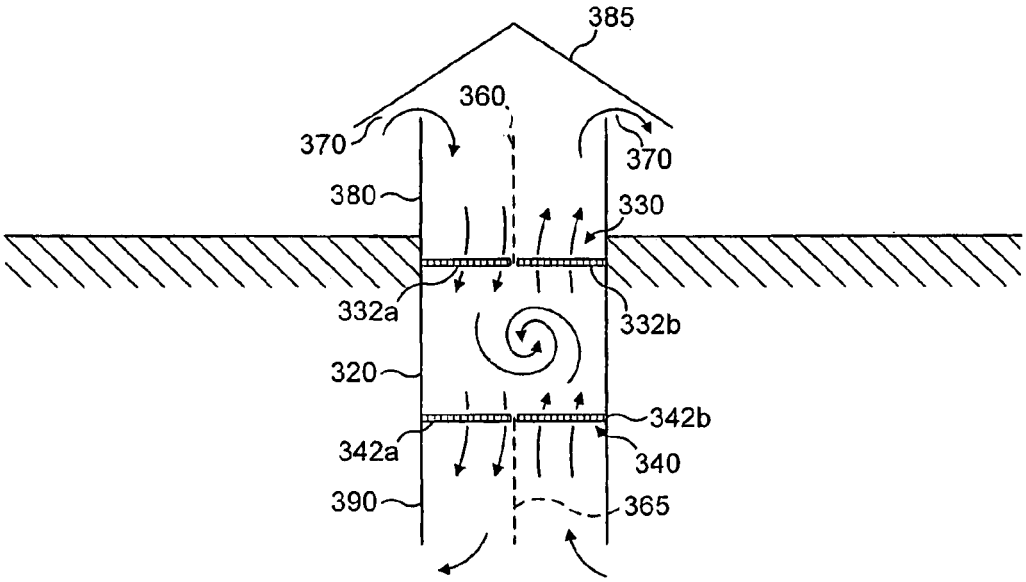
FIG. 4 shows a schematic view of a passive ventilation stack according to a fourth embodiment of the invention.
Figure 5:
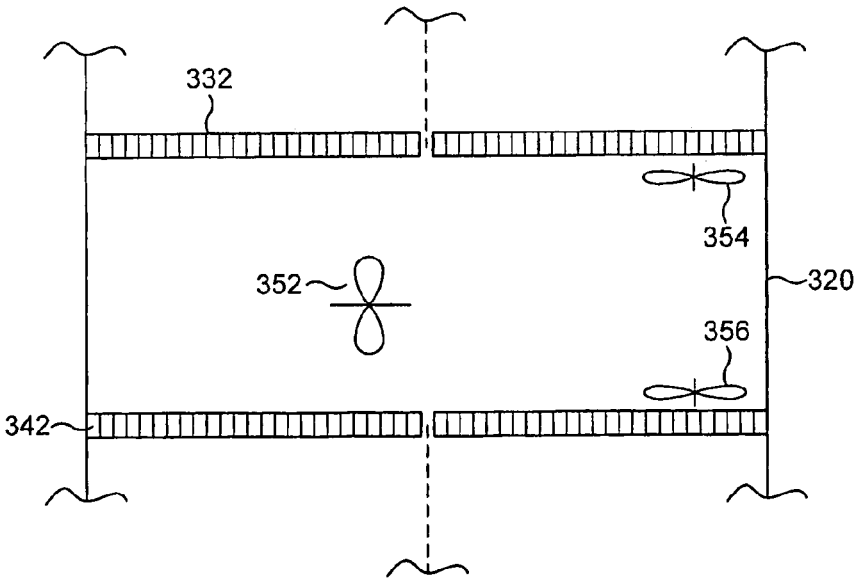
FIG. 5 shows a schematic enlarged detail view of the passive ventilation stack of FIG. 4.

In a fourth embodiment of the invention shown in FIGS. 4 and 5, a stack 320 is located between an upper stack 380 and a lower stack 390. The stack 320 includes a first opening 330 providing fluid communication between the stack 320 and the upper stack 380, and a second opening 340 providing fluid communication between the stack 320 and the lower stack 390. Valve members 332 are located in opening 330 to vary the size thereof. In FIG. 4, the valve members are shown as multi-blade dampers, through which air can pass when the blades are open or partially open, although other appropriate types of opening control member can be used. Valve members 342 are located in opening 340 to vary the size thereof. The valve members 332 may comprise two separate valve members 332*a*, 332*b* that are controllable independently of each other or they may be coupled so as to be controllable together to vary the size of the opening 330. Similarly, the valve members 342 separate valve members 342*a*, 342*b* and may be controllable independently of each other or they may be coupled so as to be controllable together to vary the size of the opening 340.

The upper stack 380 is open to the atmosphere at an opening 370 located at an upper end thereof, and is protected from unwanted ingress of debris, rainwater etc by an exterior hood 385 that is disposed above the stack 380 in spaced relation therewith, so as to allow for the opening 370 to the atmosphere. An optional partition wall 360 may be included in the upper stack 380 so as to at least partially divide the upper stack into first and second flow passages extending substantially from a lower end of the stack 380 to an upper end thereof.

The lower stack 390 is open to the room, building or the like to be ventilated. An optional partition wall 365 may be included so as to at least partially divide the lower stack 390 into first and second flow passages extending substantially between the upper end of the lower stack 390 and the room, building or the like to be ventilated. Where the partition walls 360 and/or 365 are partial dividing walls as is described here, a small amount of mixing of the incoming cool air stream and the warmer air exiting the room may take place in the upper stack 380 and/or lower stack 390 respectively.

FIG. 5 shows an enlarged detail view of the stack 320. The stack optionally includes a fan 352 mounted on an inner wall thereof to enhance mixing of the flow streams entering the stack 320 from the upper stack 380 and the lower stack 390. The orientation of the fan 352 may be variable such that it can be optimised according to operating conditions A further optional fan 354 is disposed towards the upper end of the stack 320, below or above the valve member 332, to assist in drawing air downwards from the ambient atmosphere into the stack 320. A still further optional fan 356 is disposed towards the lower end of stack 320, configured to draw air upwards from the room into the stack 320 through valve 342.

During use of this embodiment of the invention, the passive stack system can be operated such that cool air from the atmosphere is drawn through the opening 370 into the upper stack 380 as shown by the arrow in FIG. 4. The cool air flows downwards into stack 320. Meanwhile, warm air from the room is drawn upwards by the lower stack 390 into the stack 320. The cool and warm streams of air meet and mix in the stack 320, causing a certain amount of natural heat exchange between the two air streams.

The heated ventilation air then exits the stack 320 into the lower stack 390, and hence into the room, building or the like to be ventilated as before, providing the room with naturally heated ventilation air at a temperature that is comfortable for the occupants of the room.

The remaining warmer air stream is drawn into the upper stack 380 and to the ambient atmosphere.

Figure 6:
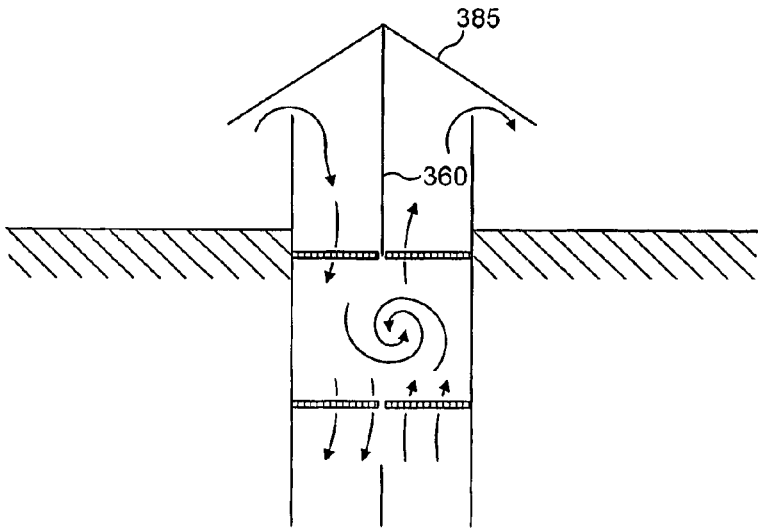
FIG. 6 shows a schematic view of the passive ventilation stack of the fourth embodiment with an extended partition.

A further variation of this embodiment is shown in FIG. 6. Here, the partition in the upper stack 380 extends all the way up to the exterior hood 385, such that the first and second passages of the upper stack 380 are completely separated from each other. No mixing of the cooler incoming air stream and the warmer room air stream occurs in the upper stack 380 in this variation.

Figure 7:
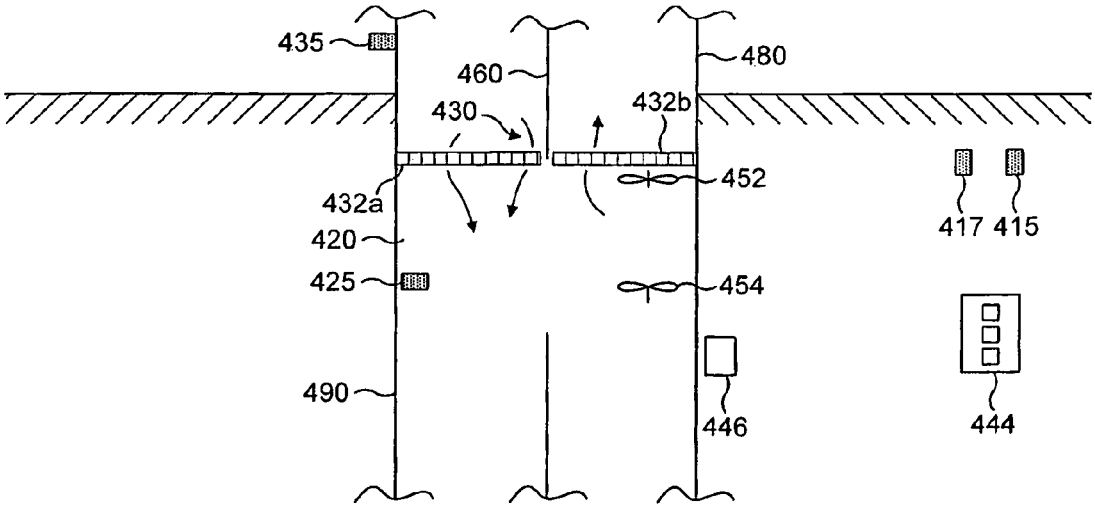
FIG. 7 shows a schematic partial view of a passive ventilation stack according to a fifth embodiment of the invention.

In a yet further embodiment shown in FIG. 7, a stack 420 comprises only one opening of variable size 430, at an upper end thereof. A pair of valve members 432*a*, 432*b* is provided to selectively vary the size of the opening 430. The opening 430 provides fluid communication between the stack 420 and an upper stack 480. A lower end of the stack 420 is open to the lower stack 490 with a fixed size opening. The stack is in all other aspects identical to the stack system of the fourth embodiment of the invention and may have a partial or full partition 460.

The valve members 432 may be controllable independently of each other as inflow valve member 432*a* and outflow valve member 432*b* or they may be coupled so as to be controllable together to vary the size of the opening 430. A controller 446 uses the inputs from a room temperature sensor 415, stack temperature sensor 425, external temperature sensor 435 and from a $CO_2$ sensor 417 to determine how the valve members 432 and the fans 452, 454 should be operated.

An example of a control algorithm for opening and closing of the valve members will now be described. The skilled man will appreciate that other ways of operating the passive ventilation stack will be possible without departing from the scope of the invention. The example algorithm pertains to the embodiment of FIG. 7, but it will be apparent to the skilled person that the algorithm can be adapted for use with each of the embodiments described herein.

In the present example, the valve members 432 are coupled to operate as a single valve member. The passive ventilation stack can be user set at a designated switch 444 to one of three different modes of operation as follows:

a) On, in 'summer' mode/'winter' mode b) On, in 'night cooling' mode c) Off

When the switch is turned on in summer/winter mode, the outside temperature ($T_e$) is measured by a temperature sensor 435. If the measured temperature is above a pre-determined temperature, here 18° C., the passive ventilation stack will operate in 'summer' mode. If the measured temperature is below the pre-determined temperature, the passive ventilation stack will operate in 'winter' mode.

In 'summer' mode, the passive ventilation stack operates to provide a predominantly upflow displacement of warm room air to the ambient atmosphere. Input of air into the room in this case occurs through another opening e.g. a window. The optional fans 452 and 454, if present, are operated in the same rotational direction and the valve members 432 are fully opened. The controller uses the inputs from temperature sensors 415, 425, 435 and from $CO_2$ sensor 417 to determine how the valve members 432 and the fans 452, 454 should be operated.

In the present example, if a $CO_2$ level of >900 ppm (parts per million) is detected by $CO_2$ sensor 417, the fans 452, 454 are operated on a slow setting, with the valve members 432 open. If a $CO_2$ level of >1000 ppm is detected, the fans are operated on a fast setting with the valve members 432 open.

Temperature sensor 415 measures the interior room temperature ($T_i$). If the measured temperature is $T_i$>21° C., the valve members are opened. If the measured temperature is $T_i$>24° C., the fans are turned on at a slow setting and the valve members are opened. If the measured temperature is $T_i$>24° C., the fan speed is set to fast and the valve members are opened. For all other measured temperatures, the valve members 432 are closed and the fans are turned off. The room temperature is checked every 2.5 minutes. The position of the valve members and the fan settings are altered accordingly.

In 'winter' mode, the passive ventilation stack is operated to provide mixing of the warm and cool airstreams. Substantially all ventilation air is obtained through the stack in this mode, and the room is otherwise substantially sealed from the exterior e.g. windows and doors are closed. Temperature sensor 425 measures the temperature in the stack 420 ($T_s$). If the stack temperature is measured to be $T_s$>15° C., the valve members 432 are opened almost completely. If 10° C.<$T_s$<15° C., the valve members 432 are opened approximately half way. If $T_s$<10° C., the valve members 432 are opened between the half way and fully closed positions.

The optional fans 452, 454 can be operated such that they rotate in counter-rotation to each other in this 'winter' mixing mode. The controller then uses the input from the $CO_2$ sensor 417 and from the room temperature sensor 415 to alter the valve member positions and fan speeds as necessary. In the present example, if the $CO_2$ measurement is >900 ppm, the valve members are opened and the fans 452, 454 are run on a slow setting. If the $CO_2$ measurement is >1000 ppm, the valve members 432 are opened and the fans 452, 454 are run on a fast setting. If the room temperature is measured at $T_i$>22° C., the valve members 432 are opened and the fans 452, 454 are run on a slow setting. If the room temperature is measured at $T_i$>24° C., the valve members 432 are opened and the fans are run on a fast setting.

For all other detected conditions, the valve members are kept closed and the fans are turned off. As with the 'summer' mode, the controller checks the inputs every 2.5 minutes.

When the switch 444 is set to 'night cooling' mode, the controller checks whether the inputs from temperature sensors 435, 415 show that the external temperature ($T_e$) is less than the room temperature ($T_i$). If the check is found to be true, the 'night cooling mode' is initiated.

The fans 452, 454 are operated in co-rotation and the valve members 432 are fully opened. The controller then checks the inputs from the $CO_2$ sensor 417 and the room temperature sensor 415 and alters the valve member 432 positions accordingly. In the present example, if the $CO_2$ measurement is >900, or the room temperature is $T_i$>18° C., the valve members are kept open. If the room temperature is $T_i$>21° C. and/or the $CO_2$ measurement is >900 and the time is between 3 am and 6 am, the fans 452, 454 are turned on and the valve members are open. Otherwise, the valve members 32 are closed.

In 'night cooling' mode, the above checks may be made every 5 minutes.

In the 'off' mode, the valve members 432 remain closed and the fans 452, 454 turned off.

The skilled person in the art will appreciate that there are many ways of programming such an algorithm, and that these are conventional in the art and will not be described here.

In each of the embodiments described above, the first and second openings are shown to be located at the top and bottom of the stack. However, one or both the openings could be located on the sides of the stack. The first and second openings need not be vertically displaced, and could be located at the same vertical level as each other. The stack or stacks may be mounted at locations other than the top of the building.

The term 'opening' will be understood by the skilled person to include an aperture or a conduit, the size of which is or may be variable to control flow rate there through. Where the valve members are single or multi-blade dampers, it will be understood that the size of the 'opening' can be varied by opening or closing the single or multiple blades.

It will be appreciated by the skilled person that the desired stack temperature depends upon the environment in which the system is operated, and that in practice it may be higher or lower than the desired temperature in the embodiment above.

The passive ventilation system may be an integral part of the building design or it may be added later as a retro-fit.

Various modifications may be made to the embodiments described without departing from the scope of the invention as defined by the following claims.

The invention claimed is:

1. A passive ventilation stack for a room or building, the stack having an interior space, a first opening which in use is configured for two way fluid communication through a first aperture defined by the first opening between the interior space and the room or building to be ventilated, and a second opening which in use is configured for two way fluid communication through a second aperture defined by the second opening between the interior space and ambient atmosphere, the interior space in use being configured for mixing air entering the stack from the room or building and air entering the stack from the ambient atmosphere, and a control system for varying the size of at least the second opening, wherein the first opening is configured to provide mixing of air flow through the first aperture defined by said first opening from both the room or building and from the interior space, and wherein the interior space for mixing air is disposed between the first opening and the second opening, and wherein the control system is configured to vary a size of both the first opening and the second opening.

2. The passive ventilation stack of claim 1, further comprising a second interior space adjacent the first interior space, the second opening providing flow communication between the first interior space and the second interior space, the second interior space comprising a third opening providing fluid communication between the second interior space and the ambient atmosphere.

3. The passive ventilation stack of claim 1, wherein a size of the first opening and a size of the second opening are independently variable.

4. The passive ventilation stack-of claim 1, wherein the passive ventilation stack provides substantially the only inlet of the ambient atmosphere into the room or building to be ventilated.

5. The passive ventilation stack claim of 1 wherein the stack provides substantially the only outlet of the room air out of the room or building to be ventilated.

6. The passive ventilation stack of claim 1, wherein the control system comprises an electric stepper motor.

7. The passive ventilation stack of claim 1, in which the control system comprises a fluid thermostat.

8. The passive ventilation stack of claim 1, further comprising an exterior hood disposed over the third opening.

9. The passive ventilation stack of claim 1, in which the second interior space further comprises a partition dividing the second interior space at least partially into first and second flow passages, each flow passage extending substantially between the second opening and the third opening.

10. The passive ventilation stack of claim 9, in which the partition extends fully between the second opening and an exterior hood.

11. The passive ventilation stack of claim 1, further comprising a third interior space extending between the first interior space and the room or building to be ventilated.

12. The passive ventilation stack of claim 1, further comprising at least one sensor configured to provide an input to the control device.

13. The passive stack of claim 12, further comprising at least one further sensor locatable in the room or building to be ventilated.

14. The passive ventilation stack of claim 12 in which the at least one sensor is a temperature sensor or a CO2 sensor.

15. The passive ventilation stack of claim 1, further comprising a power source configured to assist mixing of air in said interior space.

16. The passive ventilation stuck of claim 15 wherein the power source is a fan.

17. A passive ventilation stack assembly for a room or building, the passive ventilation stack assembly comprising at least a first passive ventilation stack and a second passive ventilation stack, wherein both the first passive ventilation stack and the second passive ventilation stack comprise an interior space providing a mixing space for air, a first opening, and a second opening, wherein the first passive ventilation stack and the second passive ventilation stack are arranged in series, wherein the second opening of the first passive ventilation stack in use is configured for two way fluid communication through a first aperture defined by said second opening between the interior space of the first passive ventilation stack and the interior space of second passive ventilation stack and wherein the second opening of the second passive ventilation stack in use is configured for two way fluid communication through a second aperture defined by said second opening between the interior space of the second passive ventilation stack and ambient atmosphere, and wherein each ventilation stack further comprises a control system for varying the size of at least the second opening of each stack, wherein each first opening of each stack is configured to provide two way mixing of air flow through an aperture defined by each said first opening, and wherein the interior space for mixing air is disposed between the first opening and the second opening of each stack.

18. A method of ventilating a room or building having a first opening in an upper region of said room or building, said first opening being in two way fluid communication through a first aperture defined by the first opening with an interior space substantially adjacent said room or building, said interior space having a second opening being in two way fluid communication through a second aperture defined by the second opening with the atmosphere, and at least one of the first opening and the second opening being of variable size, the method comprising:

passing room air in said upper region via said first aperture defined by said first opening into the interior space;

passing ventilation air from the atmosphere to the interior space through the second aperture defined by the second opening;

mixing in said interior space room air and ventilation air to cause heat exchange therebetween;

passing ventilation air having heat exchanged by said mixing into said room or building through said first aperture defined by said first opening;

passing room air having heat exchanged by said mixing to the atmosphere through said second aperture defined by said second opening;

the method including controlling a size of the second opening, and all other steps being substantially without use of external power, and wherein the first opening is configured to provide mixing of air flow through the first aperture defined by said first opening from both the room or building and from the interior space, and wherein the interior space for mixing air is disposed between the first opening and the second opening, in which the first opening and the second opening are of variable size, the method further comprising varying the size of the first opening.

19. The method of claim 18, wherein said second opening provides fluid communication with a second interior space, the second interior space having a third opening providing fluid communication with the atmosphere, wherein controlling the size of the second opening causes the room air in said upper region to pass via said first opening into the interior space and ventilation air from the atmosphere enters the second interior space through the third opening.

20. The method of claim 18, in which a size of the first opening and a size of the second opening are independently controllable by a control system.

21. The method of claim 20 in which the control system comprises an electric stepper motor.

22. The method of claim 20 in which the control system comprises a fluid thermostat.

23. The method of claim 18, further comprising the step of obtaining air temperature measurements in the interior space, outside of the interior space and in said room or building to be ventilated, and controlling the size of the first opening and the second opening based upon the air temperature measurements from the interior space, the outside of the interior space and in said room or building.

24. The method of claim 23, further comprising the step of obtaining a CO2 concentration measurement in said room or building to be ventilated, and controlling the size of the first opening and the second opening based upon the CO2 concentration measurement.

25. A room or building comprising a passive ventilation stack, the stack comprising: an interior space, a first opening which in use is configured for two way fluid communication through a first aperture defined by the first opening between the interior space and the room or building to be ventilated, a second opening which in use is configured for two way fluid communication through a second aperture defined by the second opening between the interior space and ambient atmosphere, the interior space in use being configured for mixing air entering the passive ventilation stack from the room or building and air entering the stack from the ambient atmosphere, and a control system for varying the size of at least one of the first and second openings, wherein the first opening is configured to provide mixing of air flow through the first aperture defined by said first opening from both the room or building and from the interior space, and wherein the interior space for mixing air is disposed between the first opening and the second opening, in which the interior space includes at least two said first openings and at least two said second openings provided at spaced locations on the room or building.

26. A room or building as claimed in claim 25, further comprising at least one sensor in the interior space, at least one sensor in the room or building, and at least one sensor located in the ambient atmosphere external to the interior space.

27. The room or building of claim 25, wherein the interior space is located at the top of the room or building.

28. The room or building of claim 25, wherein at least one splitter plate is provided within said interior space to assist mixing of air in said interior space.

29. A room or building as claimed in claim 25, further comprising a fan to assist in mixing of air in the interior space.

* * * * *